US005196082A

United States Patent [19]

Randolph

[11] Patent Number: 5,196,082

[45] Date of Patent: Mar. 23, 1993

[54] LABEL AUTO-TRANSFER TURRET REWIND ASSEMBLY

[76] Inventor: Glenn E. Randolph, 5234 Furman Pl., Charlotte, N.C. 28210

[21] Appl. No.: 495,151

[22] Filed: Mar. 19, 1990

Related U.S. Application Data

[63] Continuation-in-part of Ser. No. 115,484, Nov. 2, 1987.

[30] Foreign Application Priority Data

| | | | |
|---|---|---|---|
| Mar. 31, 1988 | [GB] | United Kingdom | 8807676 |
| Apr. 5, 1988 | [DE] | Fed. Rep. of Germany | 3811377 |
| Apr. 8, 1988 | [CA] | Canada | 563583 |
| Jun. 14, 1988 | [IT] | Italy | 20955 A/88 |
| Jun. 14, 1988 | [JP] | Japan | 63-146683 |

[51] Int. Cl.[5] ..... B65H 81/00

[52] U.S. Cl. ..... 156/353; 156/187; 156/447; 156/458

[58] Field of Search ..... 156/187, 353, 446, 447, 156/456, 458, 64, 363; 242/56 A

[56] References Cited

U.S. PATENT DOCUMENTS

| | | | |
|---|---|---|---|
| 3,930,620 | 1/1976 | Taitel | 242/56 A |
| 3,954,542 | 5/1976 | Solomon et al. | 156/363 X |
| 3,990,646 | 11/1976 | Salgo | 242/56 A |
| 4,070,227 | 1/1978 | Stuart | 156/446 |
| 4,325,766 | 4/1982 | Michael | 156/187 X |

*Primary Examiner*—David A. Simmons
*Assistant Examiner*—James J. Engel, Jr.
*Attorney, Agent, or Firm*—Ralph H. Dougherty

[57] ABSTRACT

A label auto-transfer turret rewind apparatus has a rotatable base plate journaled for rotation on a frame, the plate carrying a plurality of protruding mandrels or spindles, each of which is adapted to receive and rotate a take-up spool, which spindles are journaled for rotation in the base. Each spindle is powered by a common drive mechanism on the reverse side of the rotatable base plate, which selectively drives two or three spindles. A counter controls a cut-off mechanism for accurately placing the correct number of labels on each spool. In addition, a warning system provides an audible signal when a spool is not removed by the time the spindle rotates to a specified indexed position. Means for programmably controlling the apparatus and the method of operation are also disclosed.

19 Claims, 5 Drawing Sheets

LABEL AUTO-TRANSFER TURRET REWIND ASSEMBLY

CROSS REFERENCE TO RELATED APPLICATION

This application is a continuation-in-part of my copending application Ser. No. 07/115,484 filed Nov. 2, 1987.

BACKGROUND OF THE INVENTION

1. Field of the Invention

The present invention relates to a method and apparatus for winding reels of material onto a core. More particularly, the present invention relates to an assembly for the winding of defined lengths of webs onto a resilient core adapted for engagement onto and removal from a mandrel. The invention is particularly useful in the manufacture of labels in the printing industry.

2. Description of the Prior Art

In the manufacturing of labels, after printing, it is necessary to rewind reels of label-carrying webs bearing large quantities of labels onto smaller rolls of accurate and defined quantities of labels. In actual manufacture, it requires about twice as much time and accompanying manpower to rewind the labels as to accomplish the original manufacture or printing of the labels.

The present invention provides a method and apparatus for transferring large reels of labels onto small rolls or cores with excellent accuracy (i.e., a specified number of labels per roll) and with less than one-fourth (¼) the manpower required for the current label rewinding process.

The invented label auto-transfer turret rewind apparatus is basically a rotatable base plate having a plurality of protruding mandrels or spindles, each spindle adapted to receive and rotate a take-up spool, which spindles are journaled for rotation in the base. Each spindle is powered by a drive mechanism on the reverse side of the rotatable base plate. A counter controls a cut-off mechanism for accurately placing the correct number of labels on each spool. In addition, a warning system provides an audible signal when a filled spool is not removed by the time the spindle rotates to a specified indexed position. The entire apparatus is controlled by a programmable controller. As used herein, the term "programmable controller" means an electric or electronic device (e.g., a computer) for governing in some programmable and predetermined way the power delivered to an ancillary device.

Applicant is aware of the following U. S. Patents concerning winding machines.

| U.S. Pat. No. | Inventor | Title |
|---|---|---|
| 3,930,620 | Taitel | TURRET REWINDER |
| 3,734,423 | Kataoka | METHOD AND APPARATUS FOR CONTINUOUSLY PRODUCING SMALL DISPENSING ROLLS OF SHEET |
| 4,692,196 | Ellegood et al. | APPARATUS AND METHOD FOR WRAPPING AN EXTERNAL TAPE SUPPORT ABOUT A FILTER ELEMENT ASSEMBLY |
| 3,800,743 | Egnaczak | MATERIALS APPLICATION APPARATUS |
| 3,303,814 | Nitchie | APPARATUS FOR APPLYING ADHESIVE TO A MOVING WEB |
| 3,848,824 | Van Schijndel | FOIL COILING MACHINE |
| 4,055,313 | Yamaguchi | APPARATUS FOR EXCHANGING REWOUND ROLLS IN A ROLL SLITTING AND REWINDING MACHINE |
| 4,596,505 | Seelinger | AUTOMATIC LOADER/ UNLOADER FOR SLITTER |
| 4,518,126 | Marshall | TAKE-UP MECHANISM |
| 4,651,865 | Kupper | DEVICE FOR UNLOADING A COIL |
| 4,416,426 | Cooper | WEB TREATMENT APPARATUS |
| 1,040,188 | Gray | AUTOMATIC WINDING MACHINE |
| 1,484,842 | Nichols | SLITTING AND REWINDING MACHINE |

Taitel teaches a five spindle turret rewinder wherein the turret is driven in steps so that each spindle successively dwells in each of five stations.

Kataoka teaches a method of and an apparatus for continuously producing small dispensing rolls of sheet in strips of small thickness, of such material as paper, film of synthetic resin, wafer, aluminum foil or the like, each roll including a required amount of such sheet of small thickness wound on a core.

Ellegood et al. teaches an automatic wrapping apparatus for wrapping an external tape support about a filter element and includes an indexable turret assembly having a plurality of filter element clamps rotatably mounted at spaced radial positions on the indexable turret.

Egnaczak teaches an apparatus for coating materials onto a surface comprising a housing pivotally connected to a carriage, a chamber and applicator within the housing.

Nitchie relates to an apparatus for applying a thin coating to a moving sheet and more particularly to apparatus for applying a thin film of adhesive to a continuously moving web of paperboard.

Van Schijndel teaches a foil coiling apparatus which is described wherein a plurality of pairs of spindles are mounted upon a rotating member and moved to four successive stations including an in-feed station for cores to be gripped by the spindles, an inspection station, and two coiling stations.

Yamaguchi shows a longitudinal slitter and rewinder, which cuts a wide web into a plurality of narrow webs, and winds them onto a plurality of rolls.

Seelinger teaches a longitudinal web slitter, and also teaches two pairs of turret-type spindles 20, 21, 22, 23.

Marshall shows a winding take-up mechanism for controlling strands or webs on tubes.

Kupper shows multiple mandrels, but these are for textile threads. The mandrels appear to be individually driven.

Cooper shows a rotatable turret with four mandrels which index to various positions.

Gray shows an automatic winding apparatus with multiple spindles from an earlier era.

Nichols teaches another rewind apparatus, including the slitting function.

Each of the patents discussed above relate generally to rewinding devices, but differ both in structure and operation from the present invention.

Applicant is unaware of any prior art that accomplishes the objectives of the present invention. Consequently, a need exists for a turret rewind assembly for automatically transferring webs of material onto a core.

SUMMARY OF THE INVENTION

The invention is a label auto-transfer turret rewind apparatus, which comprises a large disc having a plurality of core-receiving mandrels protruding from one side of the disc, each journaled for rotation within a bearing housed in the disc, the other end of each mandrel carrying a drive sprocket. Two or three mandrel drive sprockets are engaged by a drive chain at any one time, the remainder being undriven, and therefore "idling". A glue unit applies glue to a core on a mandrel. A horizontally oriented unit, which includes a substrate attaching means and a cutting means, attaches a web to a glue carrying core and cuts the web. The turret indexes to a new orientation. The core is wound with labels on a web, and the procedure is repeated when the core is filled with the desired number of labels. Upon indexing to an idler position, the wound core is removed manually and an empty core is placed on the mandrel. Each core has a segmented friction core holder, by which the core is gripped when the mandrel is turning, and which readily releases its grip on the mandrel upon a simple manual maneuver by the operator. Turret operations are controlled by a programmable controller.

OBJECTS OF THE INVENTION

It is the primary object of this invention to provide a method and apparatus for rewinding label-carrying webs onto small rolls or cores with extremely high accuracy, yet with a minimum of manpower.

It is also an object of this invention to provide a method and apparatus for turning mandrel mounted in turret-fashion on a rotary plate, but only when in predetermined positions.

It is also an object of this invention to provide a method and apparatus for rewinding webs of material such as label-carrying webs, which is safe and easy to operate.

It is another object of this invention to provide means for holding a core tightly on a mandrel, yet which is easy to remove.

It is another object of this invention to provide means for programmably controlling the apparatus.

Another object of this invention is to provide means for monitoring and reporting waste, production, down time, and run time associated with the rewinding task.

BRIEF DESCRIPTION OF THE DRAWINGS

The foregoing and other objects will become more readily apparent by referring to the following detailed description and the appended drawings in which.

DETAILED DESCRIPTION

Figure 1:
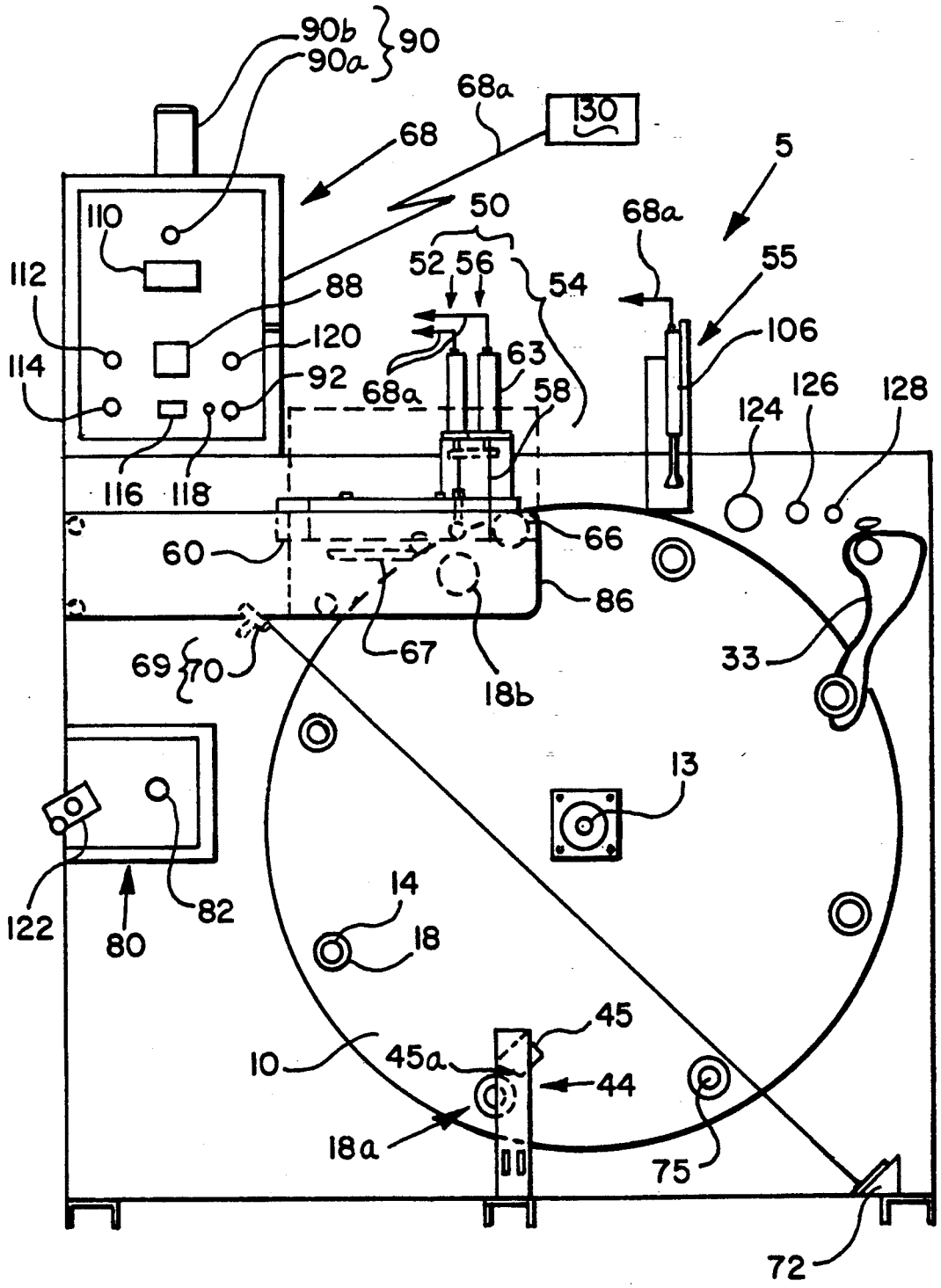
FIG. 1 is a front view of the label auto-transfer turret rewind assembly.
Figure 2:
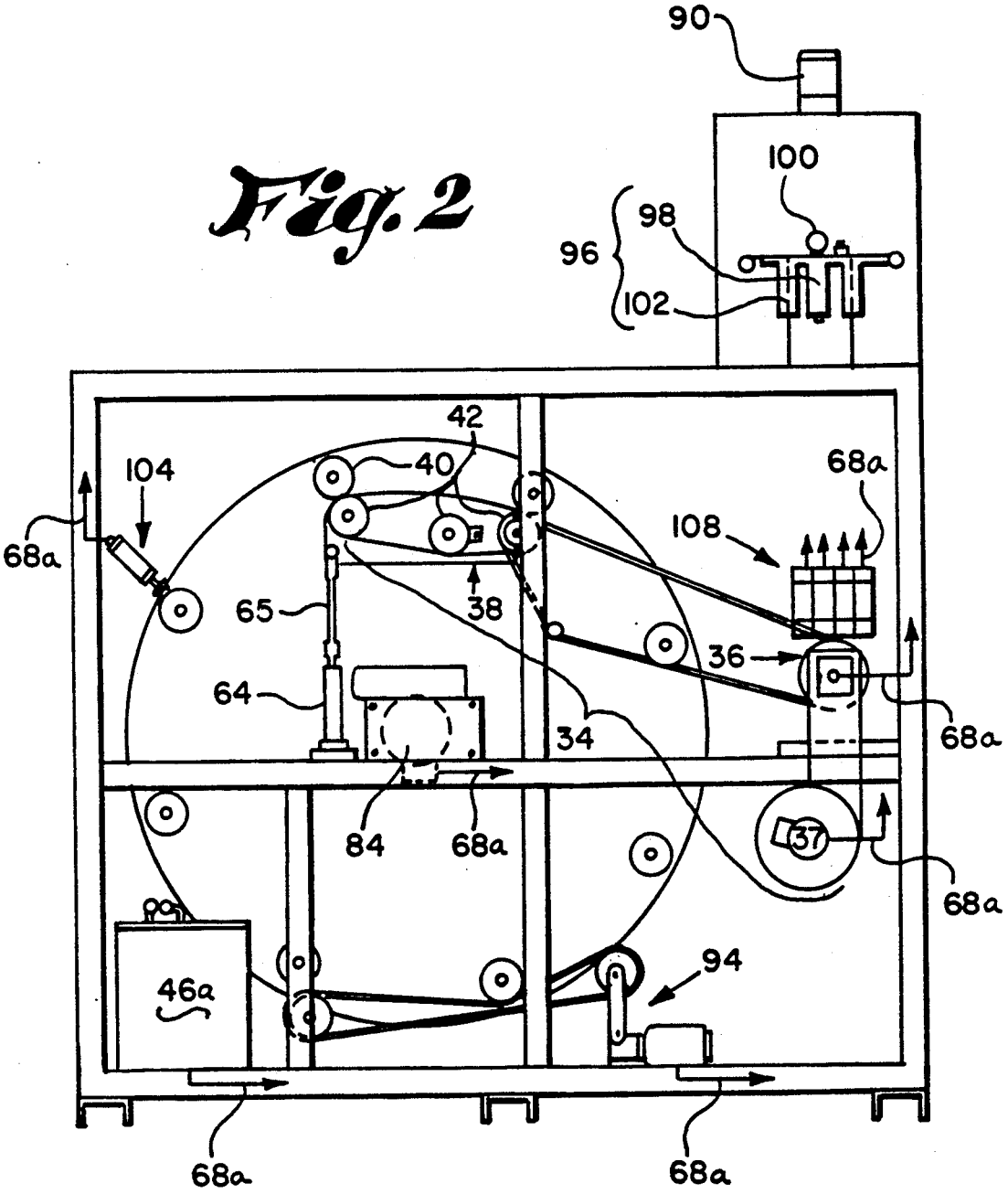
FIG. 2 is a rear view of the label turret rewind assembly of FIG. 1.

Referring now to the drawings, and particularly to FIG. 1, a label auto-transfer turret rewind assembly 5 includes a large disc 10 is mounted for rotation on a base 12, about axis 13. The disc 10 is provided with 8 label friction mandrels or spindles 14, all of which protrude from one side of disc 10 and are driven from the other side. An indexing unit 84, preferably a Ferguson indexing unit, mounted on the rear of the base 12 rotates each core-containing mandrel 14 to selected positions by rotation of the disc 10 about its axis 13. A Camco indexing unit may be used in place of a Ferguson indexing unit. Indexing of each core-containing mandrel 14 to the next position is one of the functions automatically controlled by the programmable controller 68 of the turret rewind assembly 5. A manual on/off means 120, manual cycle reject means 112 (for manually indexing the turret 5), and an emergency stop means 92 are also provided.

A number of means for automatically controlling industrial processes are commercially available. In the preferred embodiment, a programmable controller 68, such as an OMRON S6 Programmable Controller, is used to programmably control actions at each position. OMRON is a registered trademark of OMRON Electronics, Inc., located at Schaumburg, Ill. The programmable controller 68 may have input and output means 130 for collecting and reporting information concerning a variety of operational matters (e.g., printed reports concerning efficiency and operational statistics). Input and output means 130 may include one or more video display terminals, keyboards, and printers. Communication means such as wires **68*a* connect the programmable controller 68 with the appropriate controlled device (e.g., horizontal oriented unit 50, glue unit 44**).

A counter 88 is provided to accurately count the number of labels on the core 18, whereupon when a predetermined number is reached, the programmable controller generates a signal to activate movement of a horizontal oriented unit 50 which includes a substrate attaching means 52 and a cutting means 54, indexes the mandrel 14 to the next position by rotation of the disc 10 to its new orientation, and activates the glue unit 44 to apply adhesive to a newly positioned core 18 in the standby position **18*a*. A totalizer means 116 is provided which indicates the total number of labels produced in a given job. The totalizer means 116 is reset by means of a key reset device 118. Rotational speed of the mandrels 14 is preferably indicated by a light emitting diode (LED) speed indicator 110**.

A quick change sprocket drive means 80, having a tapered bushing 82, connects with drive means 34 to permit varied speed ratios. In the preferred embodiment, a pneumatic air supply 96 comprising an air regulator 98, pressure gauge 100 and a moisture trap 102, is mounted to the top of base 12 and communicates with the programmable controller 68. The programmable controller 68, thus monitors air pressure and facilitates an emergency stop in the event of an unacceptable amount of air pressure loss.

Figure 3:
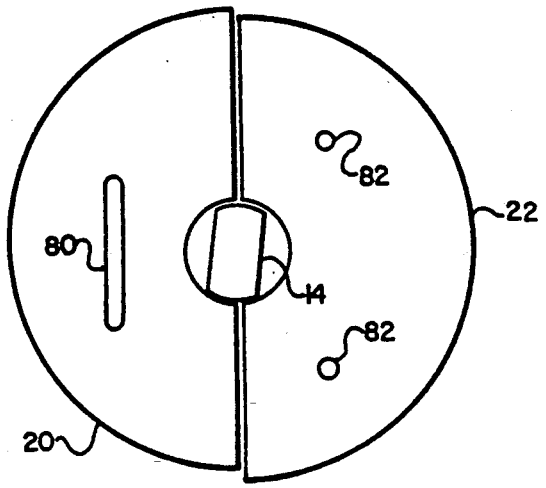
FIG. 3 is an end view of a friction core holder in the activated position, showing two alternative embodiments of core holder segment connectors.
Figure 4:
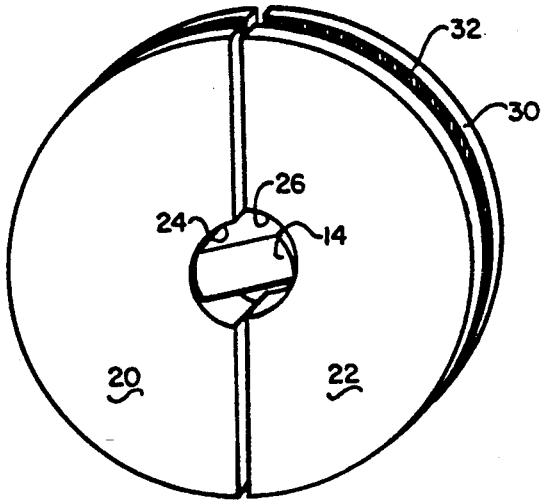
FIG. 4 is an isometric view of a friction core holder in the deactivated position.
Figure 5:
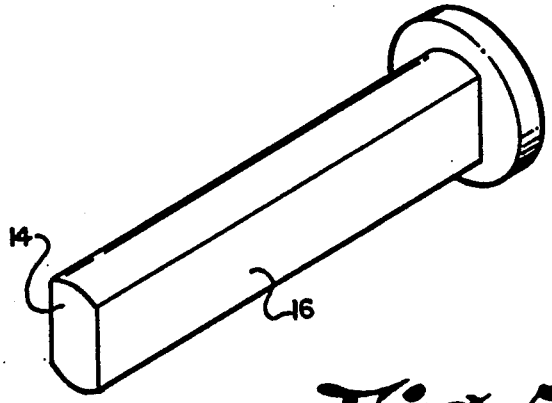
FIG. 5 is an isometric view of a mandrel in accordance with the invention.

Each mandrel 14, which has a longitudinal flat face 16 as shown in FIG. 5, holds a core 18, which is generally made of cardboard, fiberboard, vinyl, plastic, or other resilient material. The core 18 is held onto the mandrel 14 by a core holder 19, preferably of the type described in U.S. Pat. No. 4,893,765. The core holder 19 includes a pair of semi-circular disc-like segments 20, 22 as shown in FIGS. 3 and 4, which have slightly offset respective centers 24, 26. Each segment 20 is identical to segment 22, but is reversed when mated. Mandrel 14 has a pair of longitudinal flat faces 28, which accommodate the off-set centers in the non-round orientation, as shown in FIG. 3. The segments 20, 22 preferably have an annular outer groove 30 for receiving a resilient band or O-ring 32 to hold the mated segments together. A core positioning gauge 33 is mounted to the base 12 and engages each core assembly upon indexing. The weight of the core positioning gauge 33 is off center to the perpendicular rotating axis 13, thus tending, due to gravity, to align and engage each time there is an indexing cycle.

A glue unit 44 includes means 45 for applying glue to a core 18 prior to attaching the web, and a glue-containing receptacle 46. In the preferred embodiment, the glue applying means 45 includes at least one nozzle **45*a*, in communication with the glue-containing receptacle 46, which releases glue in accordance with instructions from the programmable controller 68. The glue-containing receptacle 46, mounted on the rear of the base 12, is preferably a stainless steel air pressurized adhesive supply reservoir 46*a* for storing and providing glue to the glue applying means 45. A core assembly rotating device 94 is provided for core rotation during application of adhesive. A motor 94*a* drives a belt and chain pulley system 94*b* which engages mandrel drive sprockets 40, thereby rotating the mandrel 14 at location 18*a* during adhesive application. The motor 94*a* is powered on and off under direction of the programmable controller 68**.

The programmable controller 68 also controls a horizontal oriented unit 50 which includes a substrate attaching means 52 and a cutting means 54. Preferably, the cutting means 54 comprises a web cutting assembly 56, including a cutting blade 58, mounted for horizontal movement on a track 60, which is fixed to frame 12. A first solenoid-actuated pneumatic cylinder, not shown, is connected to the blade assembly 58 for horizontal movement along the track 60. A second solenoid-actuated pneumatic cylinder 63 controls vertical movement of the blade 58. The cutting assembly 56 includes a web guide roll 66 which controls the angle and path of the web as it is being cut. If desired, the blade 58 can be set to cut at an angle of up to 45 degrees from the vertical. A safety guard 86 may be provided to prevent contact of any person with the cutting blade. A razor blade holder 67 is mounted underneath the track and adapted for length-wise slitting of the web. A finish roll rotation stopping device 55 is mounted to the base 12 and adapted for stopping the rotation of a core 18 after the cutting assembly 56 has cut the web. The stopping device 55 is vertically controlled by a fourth solenoid-actuated pneumatic cylinder 106, which is in turn controlled by the programmable controller 68.

A detector 69, comprising a photoelectric cell 70, is focused at a location indicated by reflector 72, and is so adjusted that its beam is aimed to just miss a mandrel 14 if it carries a filled core 18 thereon. The detector 69 is controlled by the programmable controller 68 and is provided with an audible **90*a* and visual 90*b* alarm 90 which also controls an emergency stop 92 for preventing further indexing of the turret apparatus 5 until the label or web-containing core 18 can be removed from the mandrel 14 at the focused position indicated at 75. In general, the audible and visual alarm 90 engages whenever the turret 5 is about to cycle, a finished core 18 has been left undoffed in a specific core position 75**, or an emergency stop situation exists (e.g., low air pressure situation).

The reverse side of the turret rewind base 12 carries drive means 34, including a pressure regulated friction drive power transmitter 36, having a cooling fan motor 37 for cooling the transmitter 36, and a double chain drive assembly 38 which include sprockets 42 having a single row of teeth and the double row chain powered by the friction drive transmitter 36. The double row chain drive assembly 38 is adapted to engage mandrel drive sprockets 40. A single chain drive assembly 39 connects the transmitter 36 and the double chain drive assembly 38 together. A third solenoid actuated pneumatic cylinder 64 is mounted on the frame of base 12 and carries a rod 65 extending to and connecting to the double chain drive assembly 38. The rod 65 engages and disengages the assembly 38 and controls finished and/or rejected cores 18 under the direction of the programmable controller 68. Finish roll rotation stopping device 55, on the face side of the assembly, stops the filled core 18 upon disengagement of the assembly 38. Sprockets 42 are provided to create proper tension in assembly 38 and the proper drive angle of assembly 38 with regard to each mandrel drive sprocket 40 in a driven position. The reverse side of the turret rewind base 12 also carries a stacked electromagnet assembly of air valves 108, each of which devices, and each air valve, are controlled independently of each other through the programmable controller 68.

In operation, electric power is provided through start button 114 to the turret assembly 5, and a core 18 is placed on a mandrel 14 prior to the mandrel 14 being indexed to the location for web accumulation. As it approaches location **18*b*, the mandrel 14 begins turning, as its associated drive sprocket 40 is engaged by drive means 34. When the active core 18 is filled, upon reaching the predetermined count set on counter 88, the horizontal unit 50 slices the label-containing web and retracts horizontally to permit indexing. The turret 5 then indexes to the next operating position, and the glue unit 44 applies adhesive to the next core 18**.

Immediately upon horizontal retraction of the horizontal unit 50, the core 18 is accumulating web. The turret 5 then indexes to the next station, thereby revolving the disc 10 one-eighth of a revolution. The web-filled core 18 is removed after the turret 5 has indexed once, so that the associated drive sprocket 40 for the mandrel 14 which that core 18 is gripping is no longer engaged by drive means 34, and the mandrel 14 is no longer turning. Mandrel 14 is held in place by core holder assembly holding device 104. Holding device 104 holds the mandrel 14 in place immediately after the turret 5 indexes. Upon reaching that core location, indicated at **18*a*, the glue unit is activated, the applicator applying glue for one revolution, the exact time of the glue application being controlled by the programmable controller 68. The empty core 18 is turning prior to the glue being applied at location 18A, and the core 18 is also turning while it is filling. The core 18 is removed from the mandrel 14 by performing a simple manual maneuver on the core holder 19**.

In summary, upon reaching a predetermined count as indicated on counter 88, the following steps occur: activating the horizontal unit 50 to both cut the web associated with a filled core, if any, and attach the trailing web to a glue carrying unfilled core; activating finish roll rotation stopping device 55 to stop rotation of the filled core; disengaging core holder assembly holding device 104 to permit removal of the filled core; retracting horizontal unit 50 to allow for indexing of the turret 5; disengaging finish roll rotation stopping device 55 to allow for indexing of the turret 5; indexing the turret 5; resetting horizontal unit 50 in preparation for repeating the process; engaging core holder assembly holding device 104; activating glue unit 44 to apply glue to a core 18; resetting counter 88; removing filled core 18; and installing new core 18.

Normally a rewind machine is required for twice as much time as the original winder. A rewind machine is used to rewind the large rolls into small, easily handled rolls for a label applicator, such as a portable label applicator. Use of the subject invention allows the reduction of required personnel by at least two or three rewinder operators, with an attendant dramatic decrease in cost of label production.

ALTERNATIVE EMBODIMENTS

Figure 6:
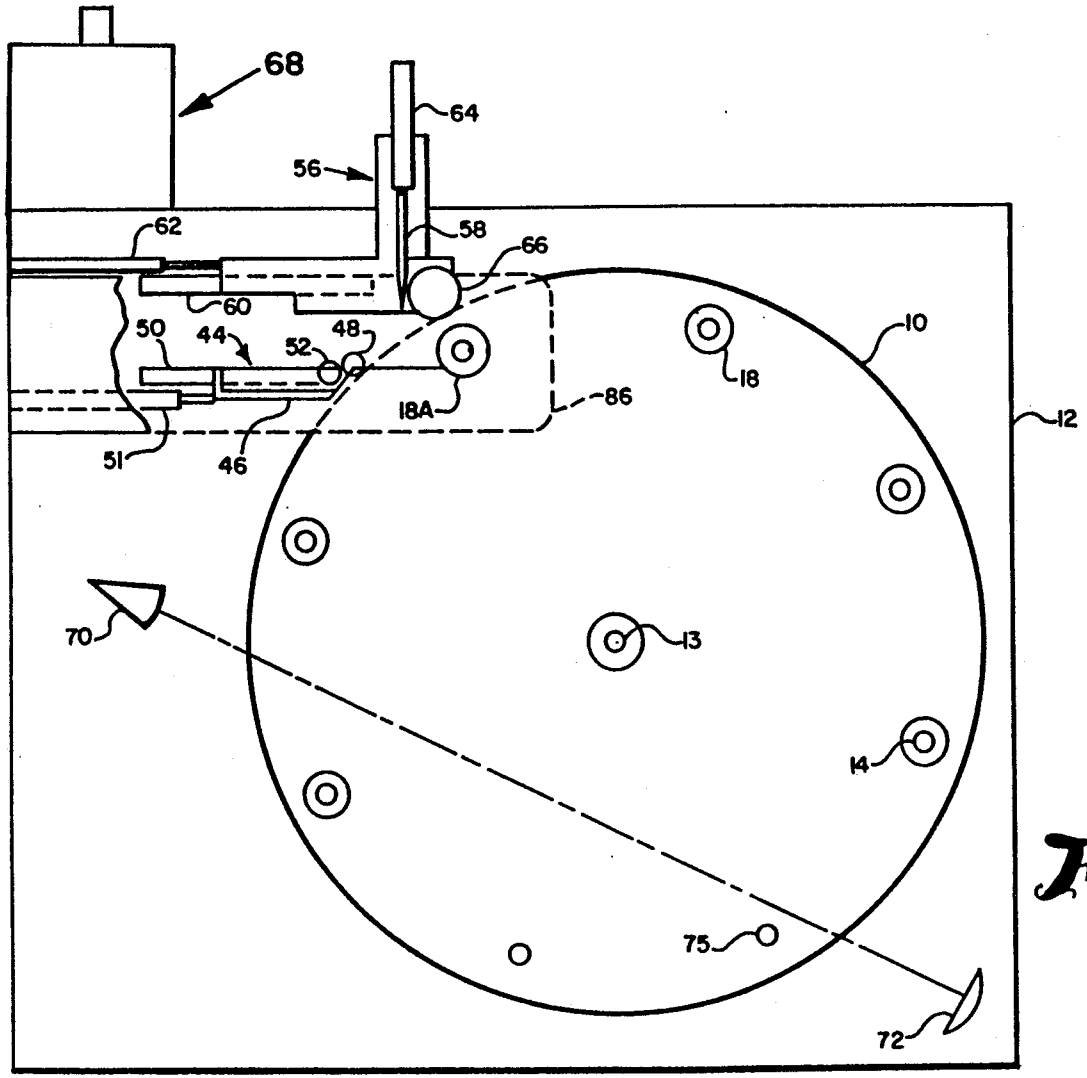
FIG. 6 is a front view of an alternative embodiment of the label auto-transfer turret rewind assembly.

FIG. 6 illustrates an alternative embodiment for the label auto-transfer turret rewind assembly 5. An alternate glue unit 44 includes a glue-containing receptacle or trough 46, a roller-applicator 48 mounted at the trough 46 so that a portion of the roller 48 extends into the glue contained in the trough 46, and means for moving the glue unit 44 laterally into and out of engagement with a core 18 on a spindle 14. The glue unit 44 is mounted on a track 50 which is connected to the frame 12, and is preferably reciprocally powered along the track 50 by a pneumatic cylinder 51. The glue unit 44 may advantageously carry a lower glue carrier roll 52 which is partially submerged in the glue pool and contacts the roller-applicator 48 by which the carrier roll 52 applies glue to the applicator roll 48, which allows the applicator roll 48 to be of a smaller diameter than otherwise would be required to extend into the glue pool in the trough 46. In addition, the use of a carrier roll 52 will prevent excessive glue from being applied to the carrier roll 52 and thus to the core 18.

Figure 7:
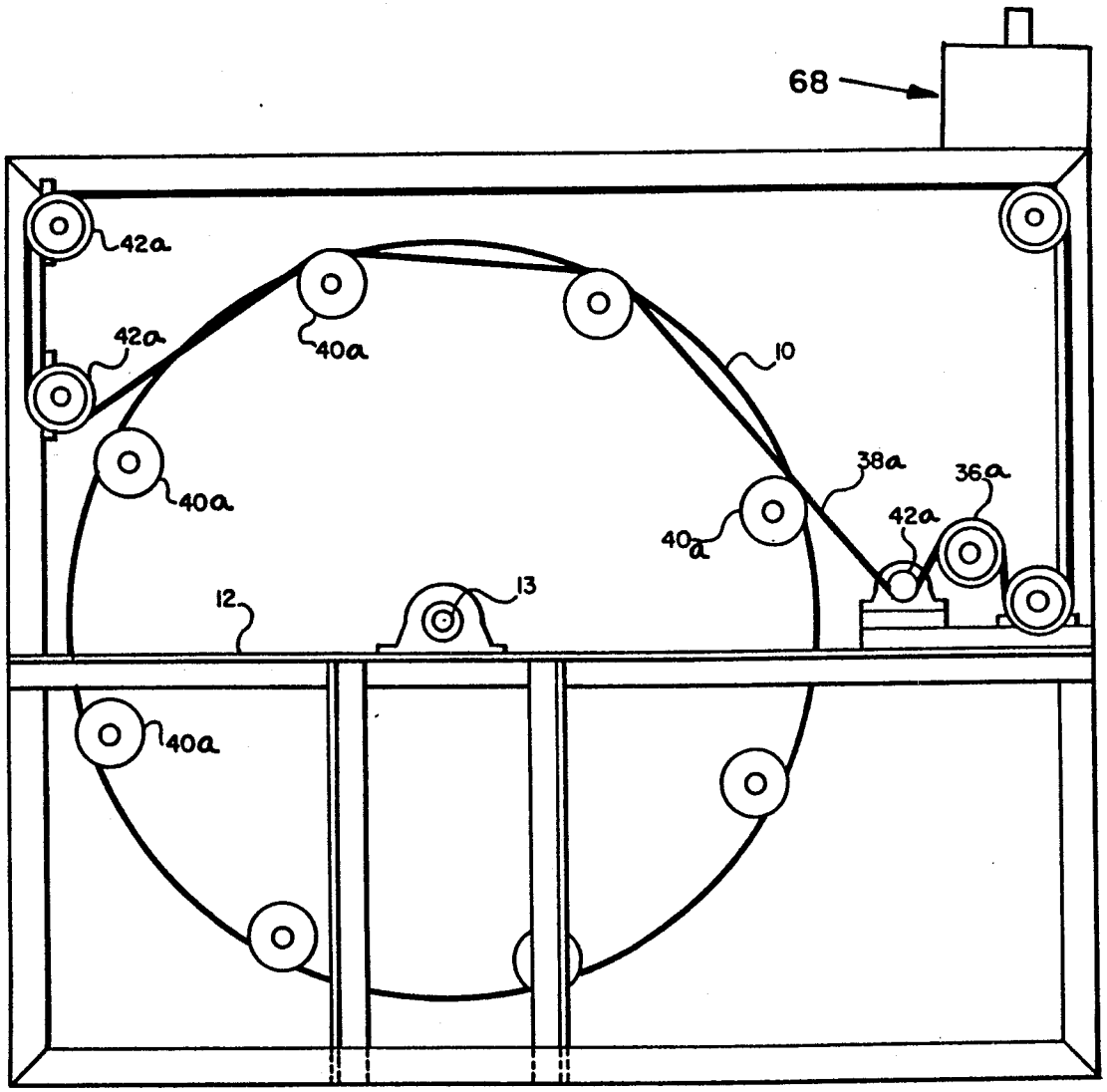
FIG. 7 is a rear view of the alternative label turret rewind assembly embodiment of FIG. 6.

FIGS. 7 illustrates an alternative embodiment for the label auto-transfer turret rewind assembly drive means 34. The turret rewind base 12 carries a drive means, including a motor driven sheave 36*a*, and a drive sheave arrangement in which drive belt 38*a* engages only two or three of the mandrel drive sheaves 40*a* at any one time. Idler pulleys 42*a* are provided to create proper tension in belt 38*a* and the proper drive angle of belt 38*a* with regard to each sheave 40*a* in a driven position.

An auxiliary air gauge 124, auxiliary air pressure regulator 126, and auxiliary emergency stop 128 may also be provided, as shown in FIG. 1. Further, an idler sprocket 122 may also be provided for tightening drive means 34.

SUMMARY OF THE ACHIEVEMENTS OF THE OBJECTS OF THE INVENTION

From the foregoing, it is readily apparent that I have invented a method and apparatus for rewinding label-carrying webs onto small rolls or cores with extremely high accuracy, yet with a minimum of manpower, a method for turning only selected mandrels mounted in turret-fashion on a rotary plate, when in predetermined positions, I have also provided an apparatus for rewinding webs of material such as label-carrying webs, which is safe and easy to operate, along with means for holding a core tightly on a mandrel, yet which is readily removable with ease.

While I have shown and described present preferred embodiments of the invention, it is to be understood that the invention is not limited thereto or thereby, but any changes or modifications within the scope of the following claims are included within the invention.

What is claimed is:

1. Apparatus for rewinding a web of material, comprising:

a frame;

a rotatable disc mounted on said frame;

indexing means for intermittently rotating said rotatable disc through a predetermined arc;

a plurality of mandrels rotatably mounted at equal intervals about said disc, said mandrels extending horizontally from said disc and being arranged with their axes being equidistant from the central axis of said disc, each of said mandrels being adapted to receive a web-receiving core thereon;

drive means adapted to rotate at least two but less than all of said mandrels as positioned in a predetermined location with regard to said frame and to engage and disengage mandrels as they move into and out of said predetermined location;

web-attaching means mounted on said frame for attaching said web to a core mounted on a mandrel;

cutting means mounted on said frame for cutting said web;

a counter communicating with said cutting means for controlling the amount of web rewound;

programmable control means communicating with said indexing means, said drive means, said web-attaching means, said cutting means, and said counter, for programmably controlling said apparatus; and a core positioning gauge pivotally connected at its upper end to said frame to bear against a mandrel adjacent said gauge, thereby providing a limit stop for placement of a core on said mandrel against said gauge.

2. Apparatus according to claim 1 wherein at least half, (normally 7), of said mandrels a core for receiving a web, said apparatus further comprising means mounted on said frame for applying glue to said core.

3. Apparatus according to claim 2 wherein said plurality of mandrels comprises eight mandrels, and at least seven of said mandrels carry a core for receiving a web.

4. Apparatus according to claim 2, further comprising means for moving the glue applying means laterally into and out of engagement with a core on a mandrel.

5. Apparatus according to claim 1, further comprising means for determining the amount of web on said core and for controlling the cutting means in response to a signal from said amount determining means.

6. Apparatus according to claim 1, wherein each mandrel is provided with a mandrel drive sprocket on the end of said mandrel opposite said core-receiving end, said drive means being a pressure regulated friction drive power transmitter, including a double chain drive assembly engaging said motor and at least two of said mandrel drive sprockets.

7. Apparatus according to claim 1, further comprising a horizontally oriented track fixed to said frame, said cutting means including a cutting blade assembly mounted for horizontal movement on said track, and means for horizontal movement of said cutting blade assembly along said track.

8. Apparatus according to claim 7, wherein said means for horizontal movement along the track is a solenoid-actuated pneumatic cylinder connected to the blade assembly and to said frame.

9. Apparatus according to claim 1, further comprising means for movement of said blade through said web.

10. Apparatus according to claim 9, further comprising a solenoid-actuated pneumatic cylinder connected to said blade.

11. Apparatus according to claim 1, further comprising a track connected to said frame, said means for applying glue being mounted on said track for reciprocal horizontal movement thereon.

12. Apparatus according to claim 11, further comprising a pneumatic cylinder for moving said glue-applying means along said track.

13. Apparatus according to claim 2, wherein said means for applying glue comprises a glue-containing receptacle, a roller-applicator mounted on said receptacle and means for moving the roller-applicator laterally into and out of engagement with a core on a mandrel.

14. Apparatus according to claim 13, further comprising a lower glue carrier roll mounted for rotation in said receptacle and partially submerged in glue in said receptacle, and adapted to contact said roller-applicator to apply glue to the applicator roll.

15. Apparatus according to claim 1, further comprising an audible alarm activatable by a signal generated by said detector.

16. Apparatus according to claim 1, wherein said means for programmably controlling said apparatus is a programmable controller.

17. Apparatus according to claim 1, further comprising input and output means for collecting and reporting information concerning operational matters.

18. Apparatus according to claim 1, wherein said input and output means includes one or more video display terminals, keyboards, and printers.

19. Apparatus according to claim 1, further comprising detector means on said frame for determining the presence of a core on a mandrel, said detector means comprising a photoelectric cell mounted at one side of said frame, and a reflector mounted at a lower elevation near the bottom of the other side of said frame, the beam of said cell being aimed to closely miss a mandrel carrying no core thereon generate a signal, but aimed sufficiently close to impact a core carried on said mandrel and generate no signal.

* * * * *